US007694445B2

(12) United States Patent
Kelly

(10) Patent No.: US 7,694,445 B2
(45) Date of Patent: Apr. 13, 2010

(54) ADVERTISING/PROMOTIONAL DISPLAY

(75) Inventor: Charles Robert Kelly, Wilmington, DE (US)

(73) Assignee: Structural Graphics, LLC, Essex, CT (US)

( * ) Notice: Subject to any disclaimer, the term of this patent is extended or adjusted under 35 U.S.C. 154(b) by 36 days.

(21) Appl. No.: 12/154,538

(22) Filed: May 22, 2008

(65) Prior Publication Data

US 2008/0313941 A1 Dec. 25, 2008

Related U.S. Application Data

(60) Provisional application No. 60/936,713, filed on Jun. 20, 2007.

(51) Int. Cl.
*G09F 11/00* (2006.01)

(52) U.S. Cl. ..... 40/491; 40/124.08; 40/445; 446/151

(58) Field of Classification Search ..... 40/491, 40/445, 124.08; 446/148, 151, 152, 149
See application file for complete search history.

(56) References Cited

U.S. PATENT DOCUMENTS 1,008,195 A * 11/1911 Prichard ..... 222/179.5
1,187,812 A * 6/1916 Burke ..... 472/54
3,199,238 A * 8/1965 Brown ..... 40/488
5,259,133 A * 11/1993 Burtch ..... 40/124.08
5,383,292 A * 1/1995 Whittredge ..... 40/124.08
6,237,265 B1 * 5/2001 Crowell ..... 40/491
6,513,270 B1 * 2/2003 Mackenzie ..... 40/124.08
2008/0047175 A1 * 2/2008 Kelly ..... 40/124.19

* cited by examiner

*Primary Examiner*—Lesley Morris
*Assistant Examiner*—Kristina Staley
(74) *Attorney, Agent, or Firm*—Melvin I. Stoltz

(57) ABSTRACT

By providing a pre-printed promotional system which employs a housing and a cooperating slider panel mounted to each other, with the slider panel being movable for activating a foldable graphic element to move between an open displayed position and a closed, folded position, a unique, hands-on, printed, visually exciting and interest generating advertising/promotional product is attained. Preferably, the promotional system comprises two cooperating components which are cooperatively associated to each other in sliding interengagement. Although two components are required for achieving the basic construction, alternate embodiments of the present invention may incorporate additional components for providing a further enhanced visual impact.

17 Claims, 3 Drawing Sheets

ADVERTISING/PROMOTIONAL DISPLAY

RELATED APPLICATIONS

This application is related to U.S. Provisional Patent Application Ser. No. 60/936,713, filed Jun. 20, 2007 entitled ADVERTISING/PROMOTIONAL DISPLAY.

TECHNICAL FIELD

This invention relates to advertising/promotional display systems and, more particularly, to advertising/promotional display systems for providing visually exciting and interest generating products.

BACKGROUND ART

With the ever-increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed on developing eye-catching visual displays and promotional material which stand out as being visually unique in order to receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded.

In spite of the unique visual appearance generated by such products, the overall cost of production and complexity of the assembly of these systems has prevented such prior art systems from becoming popular. In particular, many prior art systems require multi-part segments to be aligned or placed in specific registered positions or locations. This requirement is both time consuming and costly.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display operation.

Furthermore, the ever increasing consumer demand seeks to obtain promotional products which produce unique and/or surprising results. In this regard, consumers are continuously seeking products which will produce a surprising visual effect when used.

Therefore, it is a principal object of the present invention to provide a printed advertising or promotional product which is capable of being produced at a reasonable cost and provides an exciting, interest generating display.

Another object of the present invention is to provide a printed advertising or promotional product having the characteristic features described above, which enables the consumer to physically control the presentation of the display in a unique, hands-on manner.

Another object of the present invention is to provide a printed advertising or promotional product having the characteristic features described above, which is capable of mass production and assembly.

Another object of the present invention is to provide a printed advertising or promotional product having the characteristic features described above, which is completely produced and assembled without requiring special segment alignment or registration.

A further object in the present invention is to provide a printed advertising or promotional product having the characteristic features described above, which provides a unique, eye-catching, exciting and surprising visual change which is produced in response to action taken by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest generating advertising/promotional product is attained. This desirable and previously unattainable result is realized in the present invention by providing a unique, pre-printed promotional system which can be produced in a wide variety of alternate forms and/or configurations. However, regardless of the printed form or configuration desired, the promotional system of the present invention employs a housing and a cooperating slider panel mounted to each other, with the slider panel being movable for activating a foldable graphic element to move between an open displayed position and a closed, folded position.

In the basic, principal construction of the present invention, the promotional system comprises two cooperating components which are cooperatively associated to each other in sliding interengagement. Although two components are required for achieving the basic construction, alternate embodiments of the present invention may incorporate additional components for providing a further enhanced visual impact.

In the preferred embodiment of the basic construction, the promotional system of the present invention incorporates a housing, which is open on one end, and a slider panel mounted in the housing and cooperatively associated with the housing for longitudinal, sliding movement therein. In addition, the housing incorporates a plate member mounted inside the housing which incorporates an elongated, longitudinally extending slot formed therein.

In order to achieve the desired automatic, surprising, and interest generating creation of a three-dimensional, pop-up graphic element, the slider panel incorporates a pre-formed pop-up graphic element mounted thereon which is movable between a first, folded configuration and a second, fully erect, display configuration. In addition, the graphic element incorporates an activating tab arm cooperatively associated therewith which is mounted in the elongated slot of the plate member of the housing in cooperating relationship therewith.

By employing this construction, the longitudinal movement of the slider panel relative to the housing causes the pop up graphic element to automatically move from its folded configuration into its fully erect, displayed configuration whenever a portion of the slider panel and/or the three-dimensional graphic element has been removed from the housing. In order to achieve this result, the activating tab arm of the graphic element longitudinally moves along the slot formed in the plate member of the housing until it reaches the terminating end thereof.

With the terminating end of the slot being positioned for cooperative association with the edge of the housing in the preferred embodiment, the pop-up element is removed from the housing simultaneously with the tab arm reaching the terminating end of the slot. As a result, the tab arm is able to pull the folded component of the graphic element, causing the graphic element to be automatically moved into its fully erect display position simultaneously with its emergence from the housing. In this way, the presentation of the three-dimensional graphic display is achieved in a manner which provides the desired surprise and interest to the consumer as is sought by the sponsor of the promotional system.

In the preferred construction, the tab arm mounted to the folded component of the graphic element preferably comprises a generally T-shape for enabling the tab arm to be retained in the slot while also being easily slid along the length of the slot formed in the plate member of the housing for controlling the movement of the pop-up graphic element. However, if desired, alternate constructions and configurations can be employed without departing from the scope of this invention.

Furthermore, the present invention can be implemented in a wide variety of alternate configurations and constructions. In this regard, a plurality of slider plates can be mounted in a single housing in order to provide multiple pop-up display graphic elements in a single product. In addition, apertures, windows, or display zones can be formed in the housing in cooperating association with the pop-up display graphic element. In this way, the present invention can be configured for the graphic element to be displayed in the aperture, window, or display zone of the housing, as opposed to the terminating edge of the housing. Regardless of the configuration or construction employed for providing automatic movement of a graphic element from a folded configuration to a display configuration, it is intended that all variations manufactured in accordance with the present invention shall be included within the scope of this invention.

In order to further enhance the advertising/promotional display system of the present invention, both the housing and the slider panel incorporate pre-printed information which is displayed in an exciting, and interest generating manner. As a result, any information or message desired by the sponsor of the promotional display system is conveyed to the consumer in an attractive, exciting, and interesting manner. Furthermore, the incorporation of the pop-up graphic display element further enhances the excitement and interest of the user or consumer. As a result, an exciting promotional display system is realized which overcomes the prior art drawbacks and difficulties.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the present invention, reference should be had to the following detailed description taken in connection with the accompanying drawings, in which.

DETAILED DISCLOSURE

Figure 1:
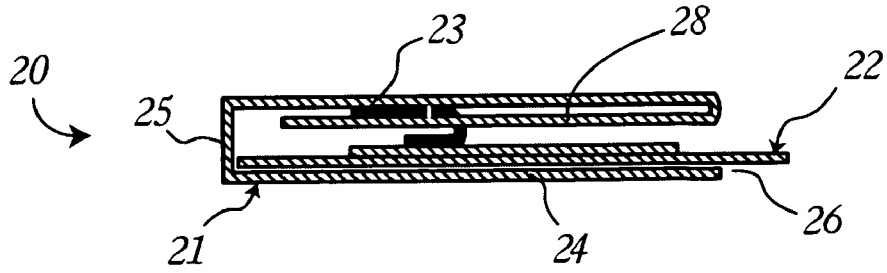
FIG. 1 is a cross-sectional, side elevation view of one embodiment of the advertising/promotional display system of the present invention shown in its fully assembled, and un-activated position.

By referring to FIGS. 1-15, along with the following detailed discussion, the construction and operation of the preferred embodiments of the present invention can best be understood. However, although several alternate constructions of the preferred embodiments are fully detailed in the following disclosure and shown in these drawings, additional constructions and variations can be made without departing from the scope of the present invention. Consequently, it is to be understood that the present invention encompasses all such variations of construction and the preferred embodiments detailed herein are provided for exemplary purposes only and not as a limitation of the present invention.

As shown in FIGS. 1-15, the preferred embodiments of advertising/promotional display system 20 of the present invention incorporate housing 21 and slider plate 22. In the preferred construction, housing 21 comprises a generally closed configuration incorporating at least one opened end or edge. As depicted, housing 21 comprises top panel 23, bottom panel 24, closed side edges 25, and open side edge 26. In addition, housing 21 also incorporates interior panel 28 which is preferably mounted inside housing 21 to top panel 23.

In the preferred construction, interior panel 28 preferably comprises an elongated, longitudinally extending slot 29 formed therein which is constructed for cooperative association with slider plate 22 and three-dimensional, pop-up display element 30 affixed thereto. In this way, as is more fully detailed below, the longitudinal movement of slider plate 22 relative to housing 21 causes three-dimensional pop-up display element 30 to automatically move from its folded configuration to its fully displayed configuration. In addition, pop-up display element 30 is constructed to remain in its folder configuration while retained in housing 21, and automatically moved into its second, fully erect, unfolded display position upon removal from housing 21. In this way, excitement and interest is generated.

Slider plate 22 preferably comprises an elongated, longitudinally extending, substantially flat support member on which three-dimensional, pop-up display element 30 is mounted. As shown, slider plate 22 is dimensioned for being inserted and retained in housing 21, with a portion of slider plate 22 extending outwardly from housing 21 when slider plate 22 is fully inserted therein. This portion may comprise any desired size or shape, but typically is, at least, an easily accessible pull tab to enable the user to longitudinally move slider 22 relative to housing 21.

Figure 2:
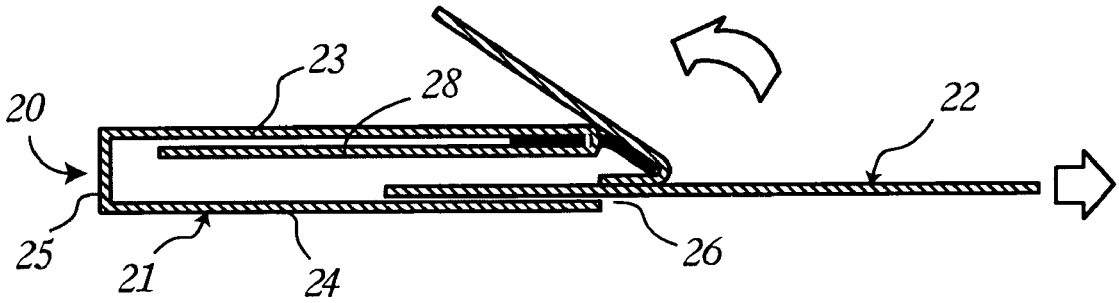
FIG. 2 is a cross-sectional, side elevation view of the advertising/promotional display system of FIG. 1 shown in its fully assembled and activated position.
Figure 9:
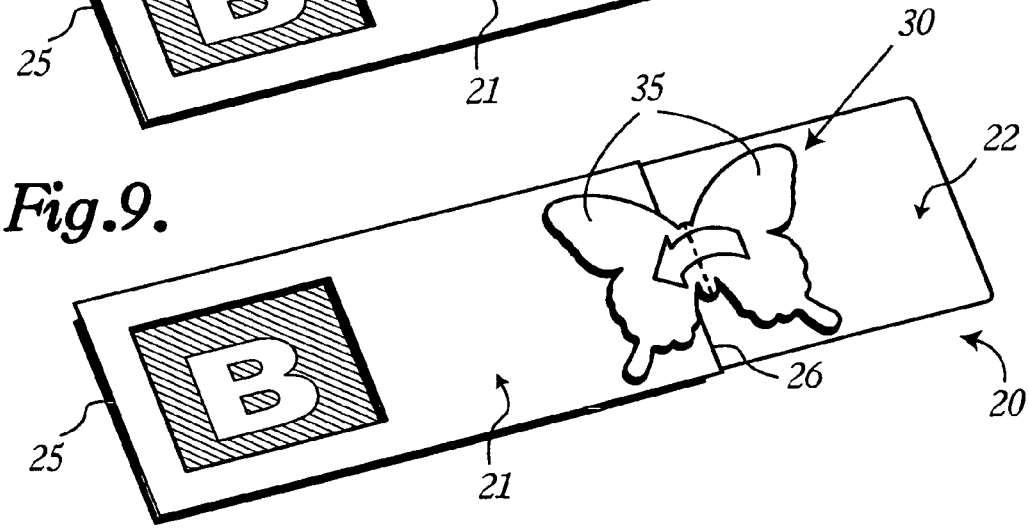
FIG. 9 is a perspective view of the advertising/promotional display system of FIG. 6 shown fully activated.

In addition, three-dimensional, pop-up display element 30 is mounted to slider plate 22 and is movable between a first, folded configuration, as depicted in FIGS. 1, 6, 7 and 8 and a second, fully erect, display configuration, as depicted in FIGS. 2 and 9. As is more fully detailed below, the movement of three-dimensional, pop-up display element 30 from its first position to its second position is automatically achieved whenever slider plate 22 is moved longitudinally between its fully stowed position in housing 21 and its longitudinally extended position relative to housing 21.

In the preferred embodiment, three-dimensional, pop-up display element 30 comprises a plurality of cooperating panels depicted as panels 34 and 35 which are mounted to each other in folded relationship. In addition, elongated support strip 36 is also mounted to slider plate 22 extending from slider plate 22 to panels 35 and interior panel 28. By constructing panels 34 and 35 and supporting strip 36 in a wide variety of alternate sizes, shapes, and configurations, the desired visual configuration and impact being sought for three-dimensional, pop-up display element 30 is achieved. In addition, the surfaces of panels 34 and 35, which become visible when display element 30 is in its second, fully erect position, preferably incorporates indicia thereon to provide interest and excitement to the user.

Figure 10:
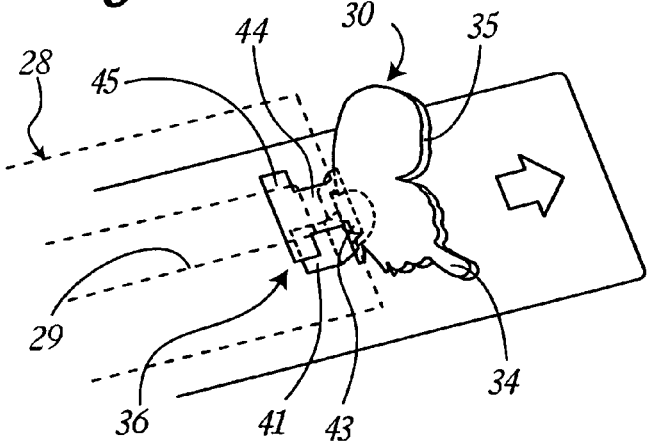
FIG. 10 is a perspective view of the slider plate assembly which forms a principal component of the advertising/promotional display system of the present invention.
Figure 11:
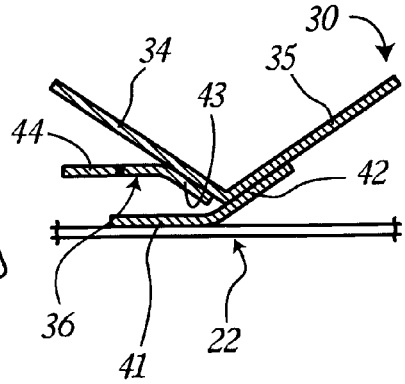
FIG. 11 is a side elevational view, partially broken away of the slider plate assembly of FIG. 10.

In FIGS. 10 and 11, one preferred embodiment of three-dimensional pop up display element 30 and elongated support strip 36 is fully depicted. In this embodiment, three-dimensional pop-up display element 30 comprises panels 34 and 35 which are cooperatively associated with each other and are movable between a first, folded position into a second, fully erect, display position. Whenever panels 34 and 35 are arcuately pivoted away from each other, pop-up display element 30 is fully displayed, enabling the indicia printed on the surfaces thereof to be visible to the user.

In addition, elongated support strip 36 preferably comprises a plurality of segments or panels which are cooperatively associated with each other. In the embodiment depicted in FIGS. 10 and 11, support strip 36 incorporates at least four separate and distinct segments or panels 41, 42, 43, and 44. As depicted, segment 41 forms one end of support strip 36 and is affixed to slider plate 22 in order to assure that support strip 36 moves in its entirety along with the longitudinal movement of slider plate 22.

In addition, segment 44 forms the opposed terminating end of support strip 36 and incorporates a T-shaped terminating end configuration 45. As shown, T-shaped terminating end 45 is constructed for being inserted within the elongated slot 29 for enabling segment 44 to move longitudinally along the length of slot 29 while being fully retained therein. As a result, whenever slider plate 22 is longitudinally moved in housing 21, elongated strip 36 moves therewith. If desired, any alternate configuration or construction for terminating end 45 can be employed which will enable terminating end 45 to be retained in slot 29 for longitudinal movement therein, while being retained in slot 29 when terminating end 45 has traveled the full length thereof.

Segment 42 is formed adjacent segment 41 with a common fold line formed therebetween. In addition, a portion of segment 42 is securely affixed to panel 35 of pop-up display element 30. Segment 43 is positioned adjacent segment 42, on one embodiment, is folded relative to segment 42, and is affixed to both panels 34 and 35 of pop-up element 30. In this way, the controlled movement of panels 34 and 35 relative to each other are easily achieved. Alternatively, segment 43 is separated from segment 42 and is affixed to only panel 34. In this way, the desired movement of panel 34 relative to panel 35 is also achieved.

In the preferred embodiment, terminating segment 44 is positioned adjacent and interconnected to segment 43, with a common fold line formed therebetween. In this way, segment 44 functions as a control arm for directly controlling the movement of panels 34 and 35 whenever T-shaped end 45 has traveled completely through the entire length of slot 29 and has reached the terminating end of slot 29. When in this position, T-shaped end 45 is captured in slot 29 and is incapable of moving any further. As a result, continued movement of slider plate 22 causes arm forming segment 44 to pull on panels 34 and 35 of pop-up display element 30, causing panels 34 and 35 to separate into their second, open and fully displayed position.

As a result, whenever slider plate 22 is fully assembled with housing 21 in the desired manner, the longitudinal movement of slider plate 22 relative to housing 21, effectively withdrawing slider plate 22 from housing 21, causes T-shaped terminating end 45 of segment 44 to advance along slot 29 of interior panel 28. However, when T-shaped terminating end 45 reaches the end of slot 29, segment 44 is unable to advance any further. As a result, segment 44 pulls segments 43 and 42, effectively causing three-dimensional, pop-up display element 30 to be automatically moved up from its folded configuration into its fully erect, display configuration.

Furthermore, three-dimensional, pop-up display element 30 is positioned on slider plate 22 to cause display element 30 to automatically move from its first, folded position into its second, display position simultaneously with the emergence of display element 30 from housing 21. As a result, the user is able to enjoy the surprising effect achieved by having pop-up display element 30 revealed as a result of the longitudinal movement of slider plate 22. In this way, substantial interest and excitement is generated by user-initiated action, causing the user to enjoy advertising/promotional display system 20 along with the information and message printed on the components thereof.

By providing this unique and surprising automatic movement of display element 30 into its fully erect display position simultaneously with the emergence of display element 30 from housing 21, a unique construction is realized and previously unobtainable goals and objectives are achieved. In addition, in the preferred construction, segment 42 of support strip 36 is connected to panel 35 in a position which enables segment 42 to lift panel 35 and panel 34 away from the surface of slider plate 22. In this way, an added pop-up effect is realized.

As is evident from the foregoing detailed discussion, alternate constructions and configurations can be implemented using the teaching provided herein, without departing from the scope of this invention. In this regard, an enlarged aperture, window, or cut out zone may be formed in top panel 23 of housing 21 with a wide variety of graphic elements or indicia visible therein, as formed on bottom panel 24, slider 22, or both. Furthermore, pop-up display element 30 may be positioned for automatic erection into its display configuration simultaneously with the movement of display element 30 from its hidden position into a revealed position within the cut-out zone, enlarged aperture, or window. In this way, an alternate configuration is easily achieved with provides a virtually identical visual impact, interest and excitement. In addition, a plurality of slider plates 22 can be mounted in a single housing 21 cooperating with either the edge of the housing or cut-out zones formed therein.

Furthermore, alternate constructions can be employed for support strut 36, T-shaped terminating end 45, and slot 29 without departing from the scope of this invention. Clearly, any construction which employs a follower member mounted to display element 30 with the follower member being longitudinally movable for activation at the precise time display element 30 emerges from a hidden position into a revealed position would incorporate the teaching of the present invention and would fall within the scope of this invention.

Figure 3:
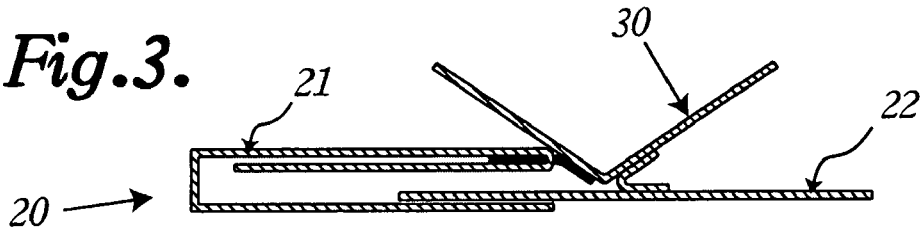
FIGS. 3-5 are cross-sectional, side elevation views of the advertising/promotional display system of the present invention depicting alternate three-dimensional display elements in their fully activated position.
Figure 4:
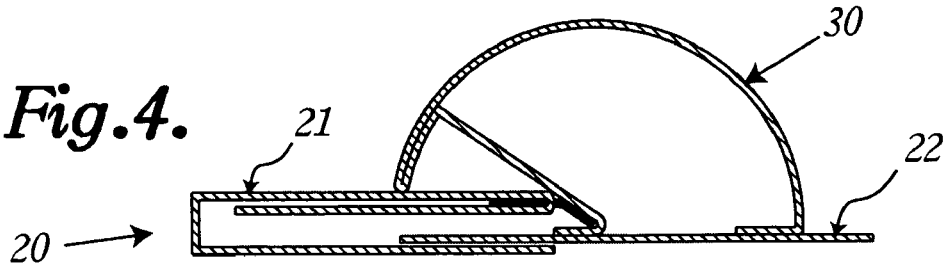
Figure 5:
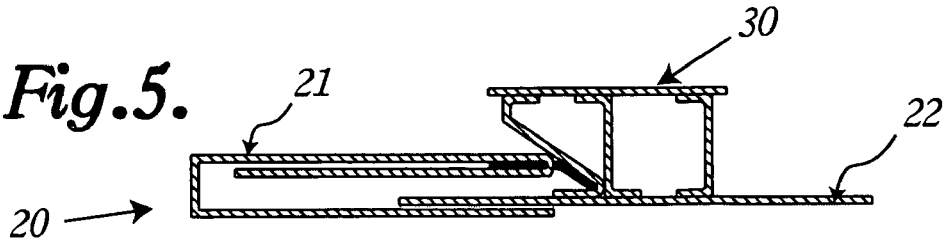
Figure 6:
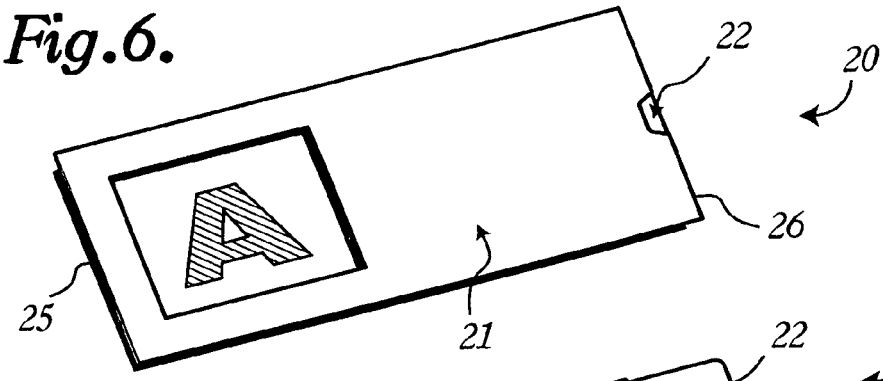
FIG. 6 is a perspective view of a further embodiment of the advertising/promotional display system of the present invention shown in its fully assembled and unactivated position.
Figure 7:
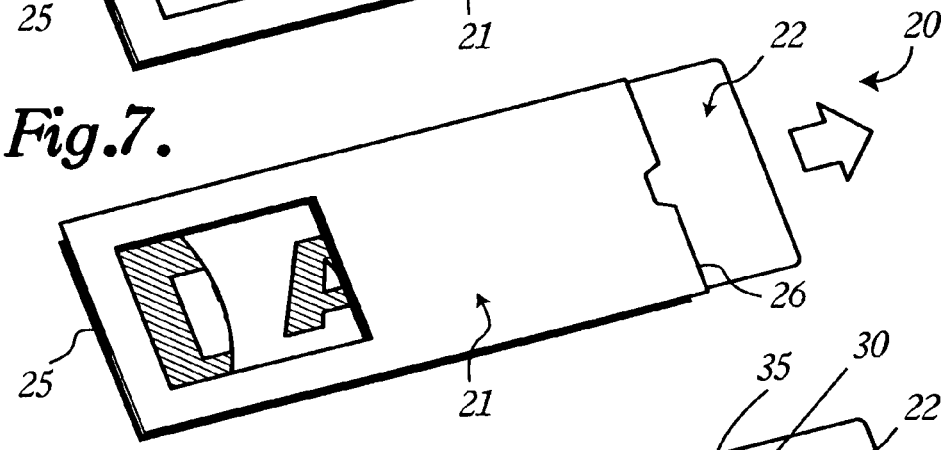
FIG. 7 is a perspective view of the advertising/promotional display system of FIG. 6 shown in the initial stages of activation.
Figure 8:
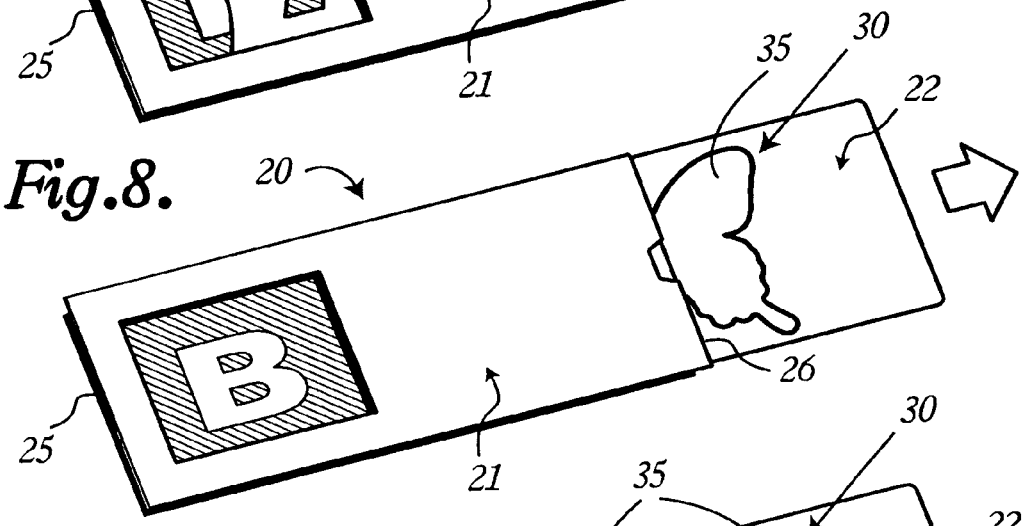
FIG. 8 is a perspective view of the advertising/promotional display system of FIG. 6 shown partially activated.

In addition, display element 30 may be configured in any size, shape, or three-dimensional construction without departing from the scope of this invention. In this regard, FIGS. 3, 4, and 5 depict examples of alternate constructions which employ the teaching of this invention without departing from the scope thereof. As is evident from a review of FIGS. 3-5, display element 30 may comprise a plurality of panels, a single curve panel, or a combination of single panels and curved panels with one or a plurality of struts integrally formed therewith. Regardless of the configuration of display element 30 or the position in housing 21 for the revelation of display element 30, these alternate configurations and constructions are all encompassed by the present invention.

Figure 12:
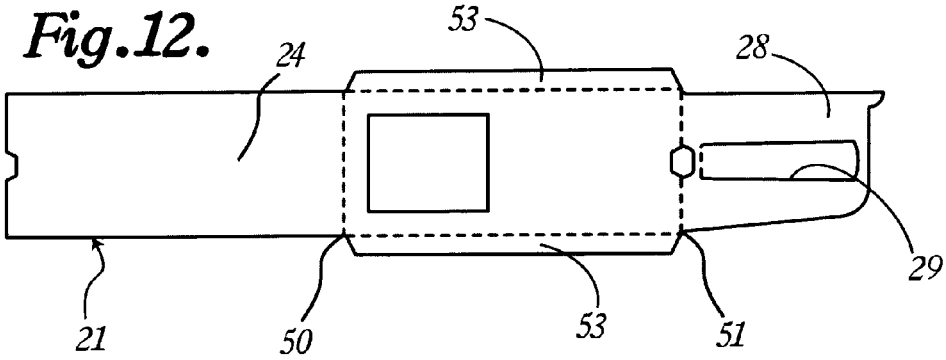
FIG. 12 is a plan view of a fully disassembled housing which forms another principal component of the advertising/promotional display system of the present invention.
Figure 13:
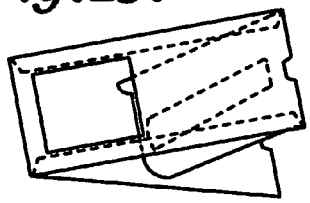
FIG. 13 is a perspective view of the housing of FIG. 12 in the process of being assembled.

In FIGS. 12 and 13, the preferred construction of housing 21 is depicted. In this preferred construction, housing 21 is preferably formed as an elongated, continuous strip of material, with bottom panel 24 formed adjacent a first side edge of top panel 23 with fold line 50 formed therebetween, while interior panel 28 is formed adjacent the other side edge of top panel 23 with fold line 51 formed therebetween. By employing this configuration, housing 21 is quickly and easily constructed, as depicted in FIG. 13, by folding interior panel 28 into contact with the inside surface of top panel 23 and then folding bottom panel 24 into contact with the exposed surface of interior panel 28. In this way, the construction of housing 21 is quickly completed by assembling slider plate 22 in position and sealing housing 21 in any desired manner. As depicted, side flaps 53 may be formed along the side edges of top panel 23 in order to provide the desired final affixation of housing 21 into its completed assembly.

Figure 14:
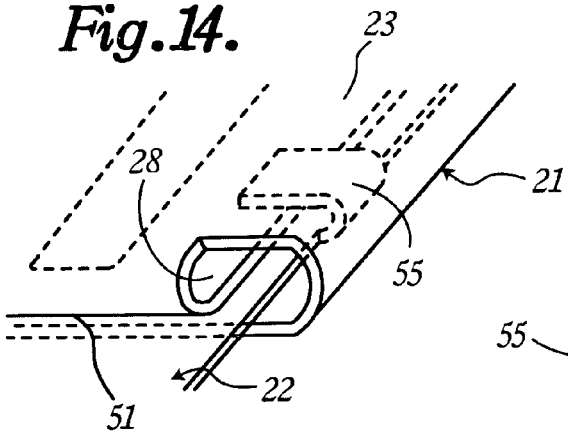
FIG. 14 is a perspective view of the fully assembled advertising/promotional display system.
Figure 15:
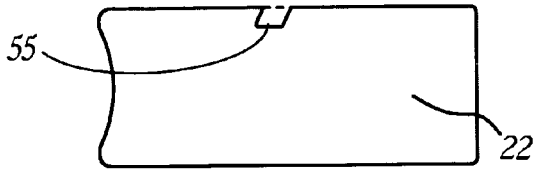
FIG. 15 is a plan view of the slider plate component of the system of display system of the present invention.

In the preferred construction, slider plate 22 incorporates a locking member to control the longitudinal movement of locking plate 22 in housing 21. In this regard, as depicted in FIGS. 14 and 15, slider plate 22 incorporates a locking tab 55 extending from one side edge thereof substantially midway along the length of slider plate 22. Of course, the precise position or location of locking tab 55 can be varied depending upon the overall length slider 22 is to extend from housing 21.

In order to enable locking tab 55 to function as a positive stop for slider plate 22, locking tab 55 is folded relative to slider plate 22 and inserted between top panel 23 and interior panel 28. In this way, locking tab 55 freely moves within housing 21 as slider plate 22 is longitudinally moved relative thereto. However, whenever slider plate 22 has been moved longitudinally outwardly from housing 21 a sufficient distance to enable three-dimensional pop up display 30 to be moved into its second, fully displayed position, locking tab 55 simultaneously contacts fold line 51 which is formed between top panel 23 and interior panel 28, preventing slider plate 22 from being withdrawn from housing 21 any further distance. In this way, a positive locking stop is achieved with slider plate 22 being easily moved outwardly from housing 21 a sufficient distance to enable three-dimensional pop up display 30 to be moved into its second, fully displayed position.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

1. An advertising/promotional display system comprising:

A) a housing comprising a first panel and a second panel, with each panel having an exposed surface on which indicia may be displayed;

B) an interior panel mounted to an inside surface of the first panel and incorporating an elongated slot formed therein;

C) a slider plate mounted in the housing between the first panel and the second panel in cooperating association therewith and movable between a first engaged position, wherein the slider plate is substantially fully retained within the housing, and a second extended position, wherein the slider plate extends outwardly, at least partially, from the housing;

D) a foldable, three-dimensional graphic element mounted to the slider plate and movable between a first, folded position and a second, unfolded, fully displayed position; and E) a connecting arm a) mounted to the three-dimensional graphic element and extending therefrom into cooperative engagement with the elongated slot of the interior panel for controlling the movement of the graphic element between the first folded position and the second unfolded, fully displayed position in response to the position of the connecting arm in said elongated slot; and b) comprising a first end cooperatively associated with the elongated slot of the interior panel for providing longitudinal movement of said arm in said slot while also preventing removal of the arm from the slot;

whereby movement of the slider plate relative to the housing causes the graphic element to move from a folded position into an unfolded display position.

2. The advertising/promotional display system defined in claim 1, wherein the first end of the connecting arm incorporates a retention element for permanently maintaining the first end in the slot while enabling the connecting arm to move longitudinally through said slot.

3. The advertising/promotional display system defined in claim 2, wherein said retention element is further defined as comprising a T-shaped end construction.

4. The advertising/promotional display system defined in claim 1, wherein the foldable three-dimensional graphic element comprises at least two panel members mounted in cooperating relationship with each other, with one of said panel members being arcuately pivotable relative to the other panel member, for providing a desired visual display when in its second unfolded position.

5. The advertising/promotional display system defined in claim 4, wherein the panel members forming the three-dimensional graphic element are further defined as comprising indicia printed thereon for providing a surprising, interest generating visual display whenever said panel members are moved into their second, unfolded, fully displayed position.

6. The advertising/promotional display system defined in claim 1, wherein the foldable, three-dimensional graphic element comprises a plurality of separate panel members mounted in cooperating relationship with each other for movement between a first folded position and a second, unfolded, visually exciting and interest generating display position.

7. The advertising/promotional display system defined in claim 1, wherein said housing is further defined as comprising a cutout zone formed in the first panel with said cutout zone overlying a portion of the slider plate.

8. The advertising/promotional display system defined in claim 7, wherein the portion of the slider plate visible through the cutout zone incorporates indicia printed thereon for enabling said indicia to be visible through the cutout zone when the slider plate is in its first, engaged position, and the second panel of the housing comprises indicia printed on the inside surface thereof and aligned with the cutout zone for enabling said indicia to be visible through the cutout zone when the slider plate is moved into its second extended position.

9. The advertising/promotional display system defined in claim 1, wherein the interior panel is mounted to the inside surface of the first panel in a position cooperating with the terminating edge of the housing for enabling the foldable, three-dimensional graphic element to move into its second, unfolded, fully displayed position simultaneously with the removal of the three-dimensional graphic element from the housing, thereby providing the visual effect that the three-dimensional graphic element emerges from the housing in its fully displayed position.

10. The advertising/promotional display system defined in claim 1, wherein the first panel of the housing incorporates a cutout zone formed therein and the interior panel is mounted to the inside surface of the first panel in a position cooperating with the terminating edge of the cutout zone for enabling the foldable, three-dimensional graphic element to move into its second, unfolded, fully displayed position simultaneously with the movement of the three-dimensional graphic element into the cutout zone, thereby providing the visual effect that the three-dimensional graphic element emerges from the housing into the cutout zone in its fully displayed position.

11. The advertising/promotional display system defined in claim 1, wherein said housing comprises indicia formed on the outer surface of at least one of said panels.

12. The advertising/promotional display system defined in claim 11, wherein said indicia comprises one or more selected from the group consisting of printed material, messages, colors, slogans, logos, graphics, alphanumerics, cutouts, and shaped objects.

13. The advertising/promotional display system defined in claim 1, wherein the housing is defined as being constructed from a single, elongated strip of material consisting sequentially of the second panel, the first panel, and the interior panel, each of which are folded relative to each other, with said first panel and said interior panel being cooperatively associated with a first common fold line and said first panel and said second panel are cooperatively associated with a second common fold line.

14. The advertising/promotional display system defined in claim 13, wherein the slider plate is mounted between the second panel and the interior panel for longitudinal movement in the housing relative to said interior panel and said second panel, with the said slider plate incorporating a tab stop member extending from a side edge thereof and positioned between the interior panel and the first panel for enabling the slider plate and tab stop member to freely move along the length of the interior panel until said tab stop member is brought into abutting contact with the first common fold line for preventing further longitudinal movement of the slider plate.

15. The advertising/promotional display system defined in claim 1, wherein said connecting arm is further defined as comprising an elongated strip of material incorporating a plurality of fold lines formed therein in spaced, aligned cooperating relationship with each other, defining a plurality of separate and independent segments along the length of said connecting arm, with a first end segment being mounted to the slider plate and a second end segment being engaged in the elongated slot of the interior panel for longitudinal movement therein.

16. The advertising/promotional display system defined in claim 15, wherein an interior segment of the elongated strip of material forming the connecting arm is further defined as being mounted to the foldable, three-dimensional graphic element for moving the graphic element between its first, folded position and its second, unfolded, fully displayed position.

17. The advertising/promotional display system defined in claim 16, wherein the three-dimensional graphic element is further defined as comprising two cooperating, foldable panel members constructed for movement between a first folded position and a second, unfolded, fully displayed position, and two adjacent interior segments of the elongated strip of material forming the connecting arm are mounted to the cooperating foldable panel members for controllably moving the panel members between their first folded position and their second unfolded fully displayed position, while simultaneously elevating the foldable panel members from the surface of the slider plate when said panel members are in their second, unfolded position.

* * * * *